US010995768B2

(12) United States Patent
Johann

(10) Patent No.: US 10,995,768 B2
(45) Date of Patent: May 4, 2021

(54) COMPRESSOR ROTOR OF A FLUID FLOW MACHINE

(71) Applicant: Rolls-Royce Deutschland Ltd & Co KG, Blankenfelde-Mahlow (DE)

(72) Inventor: Erik Johann, Berlin (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 206 days.

(21) Appl. No.: 15/789,078

(22) Filed: Oct. 20, 2017

(65) Prior Publication Data

US 2018/0112674 A1 Apr. 26, 2018

(30) Foreign Application Priority Data

Oct. 25, 2016 (DE) ..... 10 2016 120 346.7

(51) Int. Cl.
*F04D 29/32* (2006.01)
*F01D 5/14* (2006.01)
(Continued)

(52) U.S. Cl.
CPC ..... *F04D 29/324* (2013.01); *F01D 5/02* (2013.01); *F01D 5/14* (2013.01); *F01D 5/147* (2013.01);
(Continued)

(58) Field of Classification Search
CPC ..... F04D 29/284; F04D 29/324; F01D 5/02; F01D 5/027; F01D 5/10; F01D 5/30;
(Continued)

(56) References Cited

U.S. PATENT DOCUMENTS 5,292,385 A * 3/1994 Kington ..... F01D 5/02 148/404
6,354,780 B1 3/2002 Davis et al.
(Continued)

FOREIGN PATENT DOCUMENTS

DE 102008052247 A1 4/2010
EP 1507064 A2 2/2005
(Continued)

OTHER PUBLICATIONS

Partial European Search Report dated Feb. 20, 2018 for counterpart European Application No. 17197050.3.
(Continued)

*Primary Examiner* — Erick R Solis
*Assistant Examiner* — Robert A Werner
(74) *Attorney, Agent, or Firm* — Shuttleworth & Ingersoll, PLC; Timothy Klima

(57) ABSTRACT

A compressor rotor of a turbomachine includes a rotor disk; a rotor hub forming or connected to a radially outer edge of the rotor disk; and a plurality of rotor blades on the rotor hub extending radially outwards. The rotor hub includes an axially frontal leading edge, an axially rear trailing edge, a top side, a frontal bottom side extending on a bottom side of the rotor hub from the leading edge in a direction of the rotor disk and transitioning into same, and a rear bottom side extending on the bottom side from the trailing edge in the direction of the rotor disk and transitioning into same. The frontal bottom side and/or the rear bottom side of the hub is contoured in a circumferential direction of the rotor hub to form respectively one indentation in an area below a rotor blade.

19 Claims, 5 Drawing Sheets

(51) Int. Cl.

| | |
|---|---|
| ***F01D 5/34*** | (2006.01) |
| ***F01D 5/30*** | (2006.01) |
| ***F01D 5/02*** | (2006.01) |
| *F04D 19/00* | (2006.01) |
| *F04D 29/28* | (2006.01) |

(52) U.S. Cl.
CPC ..... *F01D 5/3061* (2013.01); *F01D 5/34* (2013.01); *F04D 19/00* (2013.01); *F04D 29/284* (2013.01); *F05D 2250/14* (2013.01)

(58) Field of Classification Search
CPC ..... F01D 5/3061; F01D 5/34; F01D 25/04; F01D 25/06; F05D 2250/712; F05D 2260/69; F05D 2260/691
USPC ..... 416/223 R
See application file for complete search history.

(56) References Cited

U.S. PATENT DOCUMENTS

| | | | | |
|---|---|---|---|---|
| 7,445,433 | B2 | 11/2008 | Chivers et al. | |
| 8,636,474 | B2 | 1/2014 | Evans | |
| 2005/0186080 | A1* | 8/2005 | Chivers | F01D 5/3061 416/223 R |
| 2011/0305578 | A1* | 12/2011 | Smarsly | B23K 20/1205 416/223 R |
| 2013/0209260 | A1* | 8/2013 | Stone | F01D 5/027 416/205 |
| 2015/0292337 | A1* | 10/2015 | Gentile | F01D 5/26 416/223 R |

FOREIGN PATENT DOCUMENTS

| | | | |
|---|---|---|---|
| EP | 3002414 | A2 | 4/2016 |
| FR | 2874232 | A1 | 2/2006 |
| GB | 2255138 | A | 10/1992 |
| GB | 2468722 | A | 9/2010 |
| JP | 2009197649 | A | 9/2009 |

OTHER PUBLICATIONS

European Search Report dated May 7, 2018 from counterpart App No. 17197040.3.
German Search Report dated Aug. 22, 2017 from counterpart German App No. 10 2016 120 346.7.
European Office Action dated Feb. 3, 2020 from counterpart App No. 17197040.3.
European Office Action dated Sep. 29, 2020 from counterpart App No. 17197040.3.

* cited by examiner

COMPRESSOR ROTOR OF A FLUID FLOW MACHINE

REFERENCE TO RELATED APPLICATION

This application claims priority to German Patent Application No. 10 2016 120 346.7 filed on Oct. 25, 2016, the entirety of which is incorporated by reference herein.

BACKGROUND

The invention relates to a compressor rotor of a turbomachine.

As a basic principle, it should be aimed at introducing residual compressive stresses into a material in order to limit the crack propagation in the material. This also applies to the blades of the compressor rotor of a turbomachine, in which cracks may for example be created by foreign bodies impacting the blade surface. Such foreign bodies may be external objects, in which case the term "foreign object damage" (FOD) is used, or they may be objects of the engine, in which case the term "domestic object damage" (DOD) is applied.

In order to improve the robustness of a blade with respect to foreign bodies, it is known to introduce residual compressive stresses by means of external measures, such as for example by shot peening or compacting with cooled rolling. In the course of this process, the surface roughness is also disadvantageously increased.

Document U.S. Pat. No. 7,445,433 B2 discloses to contour the bottom side of the rotor hub of a compressor rotor in a periodic manner in such a way that the rotor hub is respectively thickened in the area of a blade root.

There is a need to provide a compressor rotor of a turbomachine that has an improved robustness with respect to the damages caused by foreign bodies.

SUMMARY

According to an embodiment of the invention, a compressor rotor of a turbomachine is provided that has a rotor disk, a rotor hub, and a plurality of rotor blades that are arranged at the rotor hub, extending radially outwards. The rotor hub has an axially frontal leading edge, an axially rear trailing edge, a top side of the hub, a frontal bottom side of the hub, and a rear bottom side of the hub. The frontal bottom side of the hub extends on the bottom side of the rotor hub from the leading edge in the direction of the rotor disk, and transitions into the same. The rear bottom side of the hub extends on the bottom side of the rotor hub from the trailing edge in the direction of the rotor disk, and transitions into the same.

It is thus provided that the frontal bottom side of the hub and/or the rear bottom side of the hub is contoured in such a manner in the circumferential direction of the rotor hub that it forms respectively one indentation in the area below a rotor blade. Accordingly, the rotor hub respectively has a reduced thickness in the area of a rotor blade, wherein what is being referred to as the thickness of the rotor hub is the radial distance between the top side of the hub and the bottom side of the hub.

Due to the respectively provided indentation on the bottom side of the hub in the area of a rotor blade and the respectively accompanying thinning of the rotor hub in the area of a rotor blade, the rotor hub becomes softer in these areas. In this manner, it is achieved that the rotor blades stronger are set further upright in the radial direction during rotation of the compressor rotor as a result of the centrifugal force, with stronger residual compressive stresses being thus created in the rotor blades, in particular at the leading edge and/or at the trailing edge of the rotor blades. Due to the increased residual compressive stresses, an improved robustness against foreign objects that collide with the rotor blades, i.e. an improved FOD and DOD performance, is provided.

It is to be understood that the leading edge and the trailing edge can also be embodied in a planar manner, in which case they form a frontal face side and a rear face side. Thus, within the meaning of the present invention, the terms "leading edge" and "trailing edge" are thus to be understood in such a manner that they may refer to a angular edge as well as to a planar face side.

The invention can be realized in axial compressors as well as in radial compressors.

In one embodiment of the invention it is provided that the rotor hub respectively forms an indentation below a rotor blade, starting from the leading edge and/or starting from the trailing edge. Thus, the indentations are embodied respectively at the edges of the rotor hub and adjoining thereto at the bottom side of the hub. In this manner, it is achieved that residual compressive stresses are particularly introduced into the blades at the blade leading edge or the blade trailing edge.

In a further embodiment of the invention, it is provided that the indentations are respectively embodied in a concave manner (as viewed in the circumferential direction), extending in the axial direction in the direction of the rotor disk. Here, it can be provided that the depth of the indentation decreases in the direction of the rotor disk until it disappears completely, at the latest on the axial height of the rotor disk. Accordingly, the indentations are embodied so as to be approximately trench-shaped, wherein the trench extends starting from the leading edge or the trailing edge in the axial direction, decreasing in depth in the direction of the rotor disk.

According to one embodiment of the invention, it applies to at least one section through the hub in a plane transverse to the rotational axis that the indentation and the maximum blade root thickness in the circumferential direction cover angular ranges that overlap each other. In other words, the indentation and the maximum blade root thickness overlap if they are shifted over each other in the radial direction. At that, the blade root thickness is defined in such a manner that it comprises the thickness (i.e. the distance in the circumferential direction between suction side and the pressure side) of the blade plus the extension in the circumferential direction of the two rounded-off portions, which are also referred to as the "fillet" and form the transition from the actual blade to the rotor hub. Thus, the maximum blade thickness is that area of a rotor blade that extends in the circumferential direction and extends from the rounded-off portion of the blade on the suction side up to a rounded-off portion of the blade on the pressure side of the blade extend.

In one embodiment of the invention, it is provided that the indentations extend in the circumferential direction over a length that is between half and five times the maximum blade root thickness, in particular between the maximum blade root thickness and three times the maximum blade root thickness. This shall apply to at least one section through the hub in a plane transverse to the rotational axis, in particular at the leading edge and/or the trailing edge of the rotor hub.

Further, it can be provided that is applies to at least one section through the hub in a plane transverse to rotational axis that the maximum thickness reduction of the rotor hub that is provided by an indentation is in the range of between 5% and 30%, in particular in the range of between 10% and 20% with respect to the thickness of the rotor hub in the middle between two adjacent rotor blades.

In one embodiment of the invention, it is provided that the contouring of the frontal bottom side of the hub and/or the contouring of the rear bottom side of the hub in the circumferential direction is realized in a periodic manner in the sense that the indentations have the same relative position to the rotor blade at all rotor blades. For example, the indentations may be respectively embodied symmetrically with respect to the rotor blades.

According to an alternative embodiment, it is provided that the contouring of the frontal bottom side of the hub and/or the contouring of the rear bottom side of the hub in the circumferential direction is realized in a non-periodic manner in the sense that the indentations at least at some of the rotor blades differ with respect to the relative position to the rotor blade. As a result, such rotor blades have differing natural frequencies. Consequently, such an embodiment has the advantage that the system is detuned, and thus resonance conditions are avoided. With the system being detuned, it is avoided that energy is transported to other blades at the natural frequency, or this effect is reduced.

A detuning of the system through a non-periodic arrangement of the indentations with respect to the rotor blades is in particular advantageous in compressor rotors that have only weak damping in the transition between the blade and the rotor hub. A weak damping in the transition between the blade and rotor hub is in particular present in the case that the compressor rotor is embodied in BLISK design, in which case the rotor disk, the rotor hub and the rotor blades are embodied in an integral (one-piece) manner (BLISK="bladed disk"), or in the case that the compressor rotor is embodied in BLING design, in which case the rotor hub and the rotor blades are embodied in an integral (one-piece) manner (BLING="bladed ring"). Accordingly, it is provided in embodiments of the invention that the compressor rotor is embodied in BLISK design or in BLING design.

In other exemplary embodiments of the invention, the compressor rotor is the compressor rotor of a radial compressor, and is embodied with an integral radial compressor impeller.

In the case of a non-periodic contouring of the bottom side of the hub, it is provided in one embodiment of the invention that the contouring is realized in a non-periodic manner, namely in such a way that, for a group of neighboring blades, the relative position of the indentations with respect to the respective blade is shifted by the same amount in the circumferential direction from one blade to the other. Here, the term "in the circumferential direction" also includes a displacement counter to the circumferential direction. For example, it can be provided that the relative position of the indentations with respect to the respective blade is shifted in such a manner in the circumferential direction in a regarded group of neighboring blades that if—d2 is the maximum blade root thickness and n is the number of the blades of the regarded group—the indentations are displaced in the circumferential direction by an angle that equals d2/n from one blade to the other. Here, a group of neighboring blades may for example have between three and seven, in particular between four and six, blades.

If thus a regarded group has for example four blades, the indentation from one blade to the other is displaced by 25% of the maximum blade root thickness. Of course, it still applies here that the indentation is at least partially embodied in the area below the blades in each blade. In the circumferential direction of the compressor rotor, such groups of detuned blades can connect to each other, and thus form the compressor blading together.

According to a further aspect of the invention, a compressor rotor is provided in which the frontal bottom side of the hub and/or the rear bottom side of the hub are contoured in such a manner that it applies to each meridional section through the rotor hub that the boundary line of the frontal bottom side of the hub at least adjoining at the leading edge and/or the boundary line of the rear bottom side of the hub at least adjoining at the trailing edge can be described by an ellipse in the meridional section.

Thus, in this aspect of the invention a very specific course of the boundary line of the frontal bottom side of the hub and/or the rear bottom side of the hub adjoining at the leading edge or the trailing edge is provided, namely an elliptical course, i.e. a course, in which the boundary line lies at least partially on an ellipse. Such a shape of the bottom side of the hub has the advantage that forces acting at the bottom side of the hub are guided into the rotor disk in an effective manner.

A meridional section is made along the axial and radial direction, and contains the rotational axis. The statement that the mentioned feature applies to each meridional section through the rotor hub means that the described embodiment of the bottom side of the hub is circumferentially symmetrical.

According to one embodiment, the boundary line is embodied in an elliptical manner in its entire length up to the transition to the rotor disk. In a further embodiment, it can be provided that the boundary line extends at the bottom side of the hub from the leading edge or trailing edge over a length in the direction of the rotor disk, with its axial component being in the range of between 10% and 30% of the axial extension (between the leading edge and the trailing edge) of the rotor hub. This range relates to the axial component, i.e. the projection of the boundary line onto the axial direction. The latter is regarded because the boundary line also has a radial component in the direction of the rotational axis.

Within the meaning of the present invention, a compressor rotor may be any rotor of a compressor stage of a turbomachine. For example, the compressor rotor can be a fan rotor, a rotor of a low-pressure compressor, a rotor of a medium-pressure compressor, or a rotor of a high-pressure compressor.

Within the meaning of the present invention, a turbomachine may for example be an aircraft engine, in particular a turbofan engine, or a gas turbine for energy generation.

BRIEF DESCRIPTION OF THE DRAWINGS

The invention will be explained in more detail on the basis of exemplary embodiments with reference to the accompanying drawings in which.

DETAILED DESCRIPTION

Figure 1:
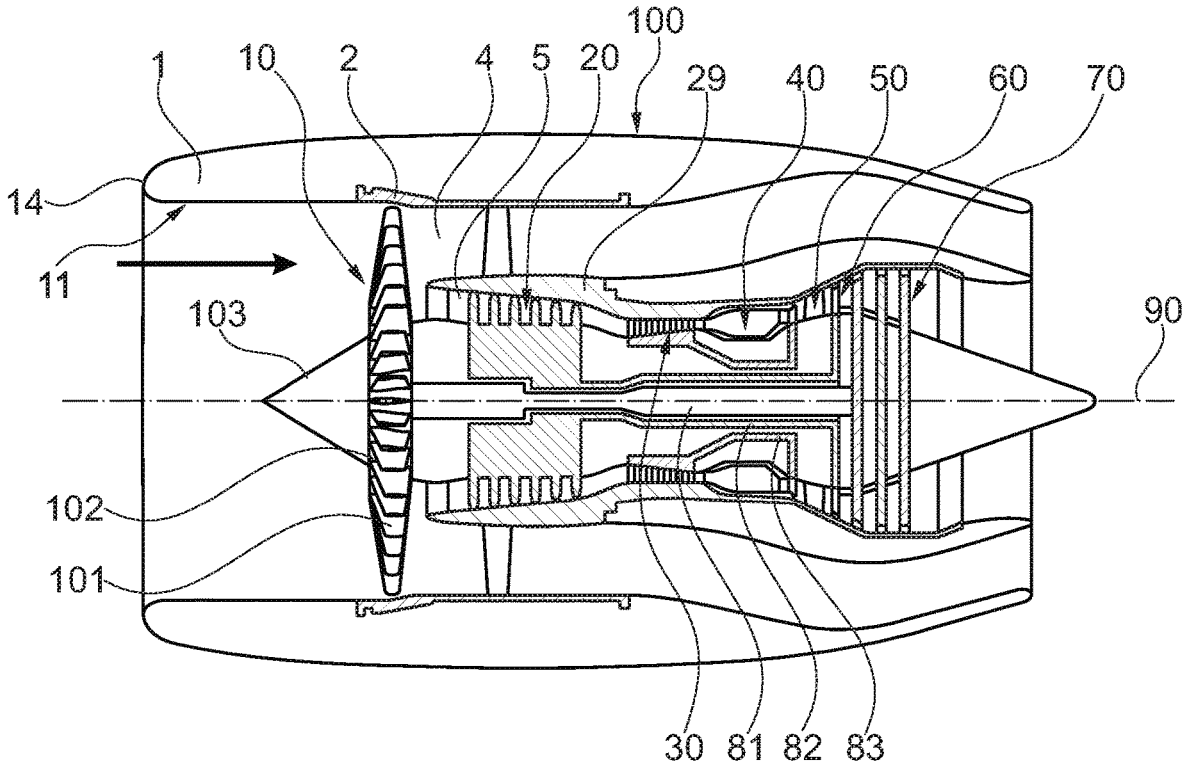
FIG. 1 shows a simplified schematic sectional view of a turbofan engine in which the present invention can be realized.

FIG. 1 shows, in a schematic manner, a turbofan engine 100 that has a fan stage with a fan 10 as the low-pressure compressor, a medium-pressure compressor 20, a high-pressure compressor 30, a combustion chamber 40, a high-pressure turbine 50, a medium-pressure turbine 60, and a low-pressure turbine 70.

The medium-pressure compressor 20 and the high-pressure compressor 30 respectively have a plurality of compressor stages that respectively comprise a rotor stage and a stator stage. The turbofan engine 100 of FIG. 1 further has three separate shafts, a low-pressure shaft 81 that connects the low-pressure turbine 70 to the fan 10, a medium-pressure shaft 82 that connects the medium-pressure turbine 60 to the medium-pressure compressor 20, and a high-pressure shaft 83 that connects the high-pressure turbine 50 to the high-pressure compressor 30. However, this is to be understood to be merely an example. If, for example, the turbofan engine has no medium-pressure compressor and no medium-pressure turbine, only a low-pressure shaft and a high-pressure shaft would be present.

The turbofan engine 100 has an engine nacelle 1 that comprises an inlet lip 14 and forms an engine inlet 11 at the inner side, supplying inflowing air to the fan 10. The fan 10 has a plurality of fan blades 101 that are connected to a fan disk 102. Here, the annulus of the fan disk 102 forms the radially inner boundary of the flow path through the fan 10. Radially outside, the flow path is delimited by the fan housing 2. Upstream of the fan-disc 102, a nose cone 103 is arranged.

Behind the fan 10, the turbofan engine 100 forms a secondary flow channel 4 and a primary flow channel 5. The primary flow channel 5 leads through the core engine (gas turbine) that comprises the medium-pressure compressor 20, the high-pressure compressor 30, the combustion chamber 40, the high-pressure turbine 50, the medium-pressure turbine 60, and the low-pressure turbine 70. At that, the medium-pressure compressor 20 and the high-pressure compressor 30 are surrounded by a circumferential housing 29 which forms an annulus surface at the internal side, delimitating the primary flow channel 5 radially outside. Radially inside, the primary flow channel 5 is delimitated by corresponding rim surfaces of the rotors and stators of the respective compressor stages, or by the hub or by elements of the corresponding drive shaft connected to the hub.

During operation of the turbofan engine 100, a primary flow flows through the primary flow channel 5, which is also referred to as the main flow channel. The secondary flow channel 4, which is also referred to as the partial-flow channel, sheath flow channel, or bypass channel, guides air sucked in by the fan 10 during operation of the turbofan engine 100 past the core engine.

The described components have a common rotational or machine axis 90. The rotational axis 90 defines an axial direction of the turbofan engine. A radial direction of the turbofan engine extends perpendicularly to the axial direction.

What is important in the context of the present invention is the embodiment of a compressor rotor, i.e. of the rotor of a compressor stage, wherein one or multiple compressor rotors of the low-pressure compressor, of the medium-pressure compressor, or of the high-pressure compressor can be embodied in the manner described in the following.

Figure 2A:
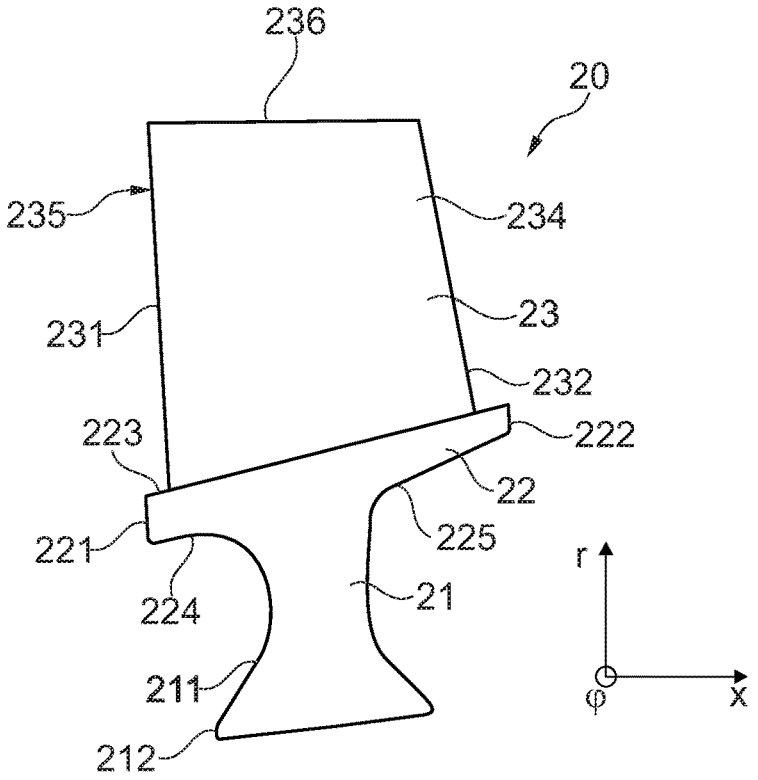
FIG. 2*a* shows a schematic rendering of a compressor rotor in the meridional section.
Figure 2B:
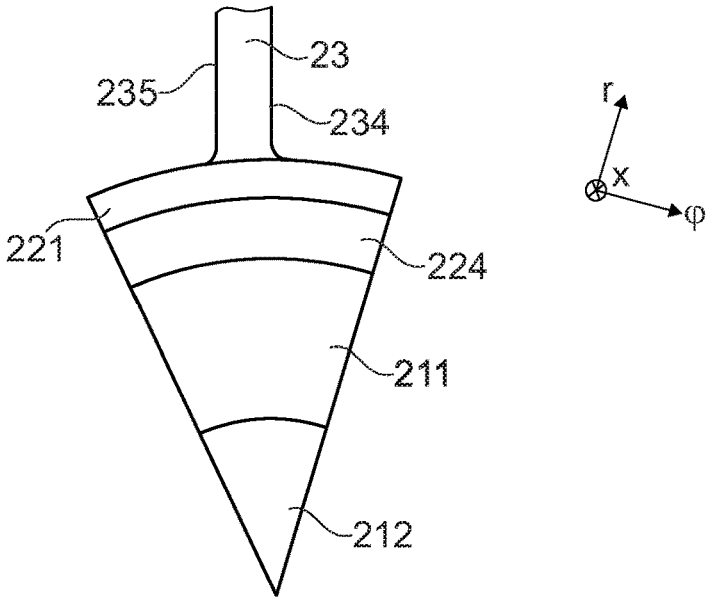
FIG. 2*b* shows a schematic rendering of the compressor rotor of FIG. 2*a* in a view from the front, i.e. in the axial direction.

The basic structure of the compressor rotor 2 is shown in the meridional section in FIG. 2*a*, and in a view from the front, i.e. in the flow direction, in FIG. 2*b*. Here, FIG. 2*b* shows only one circular sector of the compressor rotor in a view from the front.

The compressor rotor 20 has a rotor disk 21, a rotor hub 22, and a plurality of rotor blades 23. The rotor disk 21 can be rotated about a rotational axis that extends in an axial direction x (e.g. the rotational axis 90 of FIG. 1). The rotor hub 22 forms the radially outer edge of the rotor disk 21, or is connected to the same. The rotor blades 23 extend respectively radially outwards and are arranged at the rotor hub 22 so as to be spaced apart in the circumferential direction. They form the rotor blade ring of the compressor rotor 2.

The compressor rotor 20 is described in a cylindrical coordinate system having the coordinates x, r and φ. Here, x indicates the axial direction, r indicates the radial direction, and φ indicates the angle in the circumferential direction. Starting at the x-axis, the radial direction points radially outwards. Here, terms such as "in front", "behind", "frontal" and "rear" always refer to the axial direction, which substantially corresponds to the flow direction.

The rotor blades 23 have a leading edge 231, a trailing edge 232, a pressure side 234, a suction side 235, and a blade tip 236. A separate blade root is not provided in the shown exemplary embodiment, since the compressor rotor is embodied in BLISK design, i.e. the rotor disk 21, the rotor hub 22, and the rotor blades 23 are embodied in an integral manner. However, this is not necessarily the case. Alternatively, the rotor blades can respectively have a blade root that is fixated in a corresponding recess inside the rotor hub. It can alternatively also be provided that the compressor rotor is realized in BLING design, with the rotor hub 22 and the rotor blades 23 being embodied in an integral manner.

Since the compressor rotor is realized in BLISK design in the FIGS. 2*a*, 2*b*, the blade leaf transitions directly into the rotor hub 21. This also applies to the exemplary embodiments shown in FIGS. 2 to 7.

The rotor hub 22, which may also be referred to as a blade platform, has a leading edge 221, a trailing edge 222, and a top side of the hub 223 that extends from the leading edge 221 to the trailing edge 222, with the rotor blades 23 projecting from the same. The top side of the hub 223 forms a ring surface that delimits the flow channel through the rotor blade ring radially inside during operation of the compressor rotor.

Further, the rotor hub 22 has a frontal bottom side of the hub 224 that extends on the bottom side of the rotor hub 22 from the leading edge 221 in the direction of the rotor disk 21 and transitions into the same, and a rear bottom side of the hub 225 that extends on the bottom side of the rotor hub 22 from the trailing edge 222 in the direction of the rotor disk 21 and transitions into the same.

The rotor disk 21 has a disk-shaped area 211 and a disk root 212.

Figure 3:
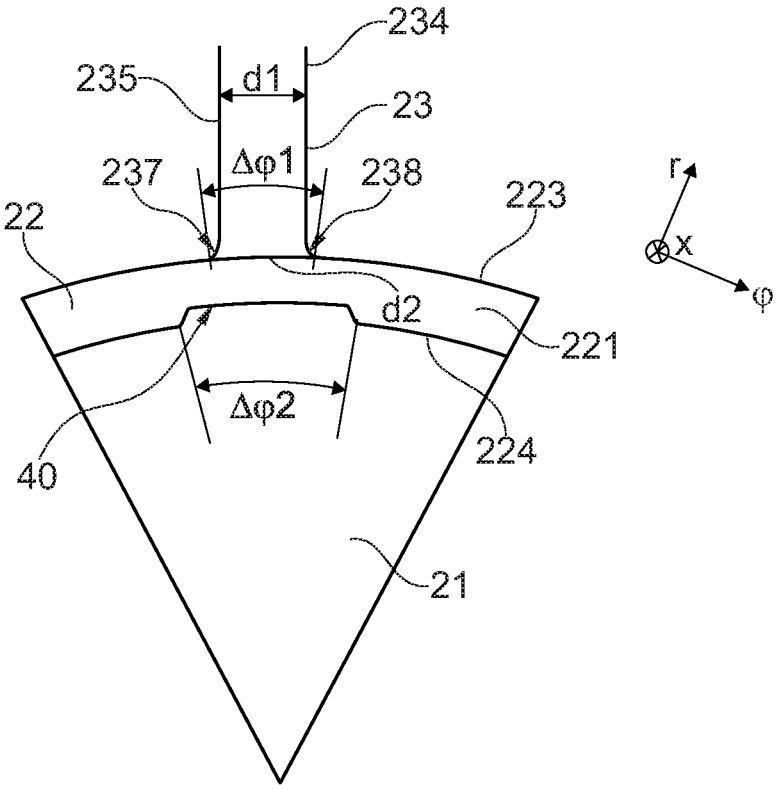
FIG. 3 shows, in a view from the front, an exemplary embodiment of a compressor rotor with an indentation that is embodied below a rotor blade, wherein only one rotor blade and one corresponding indentation are shown.

FIG. 3 shows, in a schematic manner and in a view from the front, a first exemplary embodiment. Just like FIG. 2*b*, FIG. 3 shows only a circular sector. It is provided that the frontal bottom side of the hub 224 is configured in such a manner in the circumferential direction of the rotor hub 22 that it respectively forms an indentation 40 in the area below a rotor blade 23. In the area of the indentation 40, the thickness of the rotor hub 22 is correspondingly reduced. Through the thickness reduction in the area of the rotor blade 23, the rotor hub 22 is embodied to be softer in that location, so that the rotor blades 23 are set further upright during rotation as a result of the occurring centrifugal forces, and thus can introduce residual compressive stresses into the blade 23, in particular into the leading edge of the blade 23, to an increased degree.

The indentation 40 extends in the circumferential direction as well as in the axial direction. The surface of the indentation 40 correspondingly has a larger radius (i.e. a radial distance from the rotational axis) in the circumferential direction as well as in the radial direction that the areas at the bottom side of the hub 224, which do not form an indentation.

According to one embodiment, it is provided that the indentation 40 begins at the leading edge 221 of the rotor hub and from there extends in the axial direction in the direction of the rotor disk 21. Here, it can be provided that the depth of the indentation 40 decreases in the direction of the rotor disk 21, and that is disappears completely starting at a certain axial extension (e.g. after an axial extension that is in the range of between 10% and 30% of the axial extension of the rotor hub 22). The softness that is achieved by means of the indentation 40 is thus in particular realized in the edge area of the rotor hub 22.

The indentation 40 is concave and in principle can have any desired shape. Preferably, it has soft transitions to the adjoining areas of the bottom side of the hub 224, which are not provided with an indentation.

The indentation 40 is embodied in the area below the rotor blade 23 at the bottom side of the hub 224. This will be described in more detail in the following. The rotor blade 23 has a blade thickness d1 that is defined by the distance between the suction side 235 and the pressure side 234. In the transition to the top side of the hub 223, the rotor blade forms a rounded-off portion 237, 238 at the suction side 235 and the pressure side 234 in a per se known manner, with that rounded-off portion 237, 238 also being referred to as the "fillet". What is referred to as the maximum blade root thickness d2 is the blade thickness d1 plus the thickness in the circumferential direction of the rounded-off portions 237, 238. Thus, the maximum blade root thickness d2 is the area of the rotor blade 23 that extends in the circumferential direction at its intersection point with the hub surface 223, extending from the rounded-off portion 237 on the suction side 235 up to the rounded-off portion 238 on the pressure side 234 of the blade 23.

An angular range $\Delta\varphi 1$ of the polar angle $\varphi$ of the regarded cylindrical coordinate system corresponds to the maximum blade root thickness d2. Likewise, an angular range $\Delta\varphi 2$ corresponds to the indentation 40 extending in the circumferential direction from the beginning of the indentation 40 up to the end of an indentation 40. As the indentation 40 is embodied in the area below a rotor blade 23, the indentation 40 and the maximum blade root thickness d2 overlap in the circumferential direction. This means that the angles $\Delta\varphi 1$ and $\Delta\varphi 2$ overlap at least partially. In other words, at least one section of the indentation 40 lies in the radial direction below the maximum blade root thickness d2. Like in the exemplary embodiment of FIG. 3, it is necessary here that the angle $\Delta\varphi 1$ lies completely inside the angle $\Delta\varphi 2$. Within the meaning of the present invention, the indentation 40 lies in the area below a rotor blade 23 as long as any kind of overlapping is present.

Alternatively or additionally, such an indentation can also be inserted into the rotor hub 22 in the area of the rear bottom side of the hub 225 (cf. FIG. 2*a*). In that case, increased residual compressive stresses are present during operation, with the compressor rotor rotating, in particular in the area of the trailing edge of the blade 23.

Figure 4:
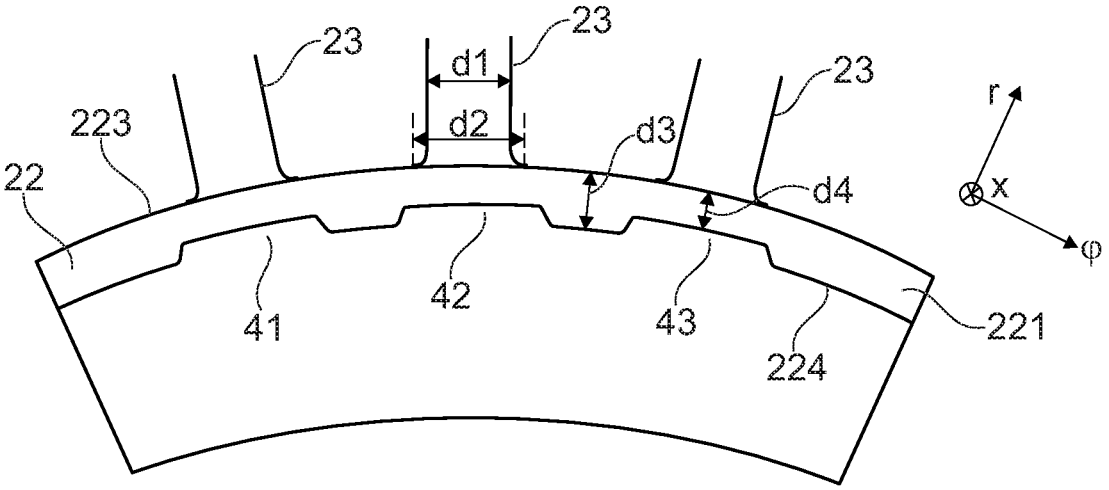
FIG. 4 shows, in a view from the front, an exemplary embodiment of a compressor rotor with indentations that are respectively embodied below a rotor blade, wherein multiple rotor blades and indentations are shown.

FIG. 4 shows an exemplary embodiment that corresponds to the exemplary embodiment of FIG. 3. Here, FIG. 4 shows an enlarged circular sector of the rotor hub 22 as compared to FIG. 3, so that a plurality of indentations 41, 42, 43 are shown. As in FIG. 3, the indentations 41, 42, 43 are arranged respectively in a centered manner below the corresponding rotor blade 23. They have the same relative position with regard to the respective rotor blade 23.

As can be seen in FIG. 4, the thickness of the rotor hub 22 varies in the area of an indentation 41, 42, 43. Since the depth of the indentation 41, 42, 43 varies in the axial direction, a change in thickness can always only be quantitatively regarded in a section in a plane transverse with respect to rotational axis. In FIG. 4, the change in thickness at the leading edge 221 of the rotor hub 22 is shown. In the area of the indentations 41, 42, 43, the thickness changes from a thickness d3 in the middle between two adjacent rotor blades 23 to a thickness d4. The thickness reduction of the rotor hub 22 from d3 to d4 may for example be in the range of between 5% and 30%, in particular in the range of between 10% and 20%, with respect to the thickness d3.

The indentations 41, 42, 43 may for example extend in the circumferential direction $\varphi$ across a length that is between half (d2/2) and five times (5*d2) the maximum blade root thickness d2, in particular between the maximum blade root thickness (d2) and three times (3*d2) the maximum blade root thickness d2, wherein the maximum blade root thickness d2 is defined in the manner as described with respect to FIG. 3. This applies to at least one section through the hub in a plane transverse with respect to rotational axis, in particular at the leading edge 221 and/or the trailing edge 222 of the rotor hub 22.

Figure 5:
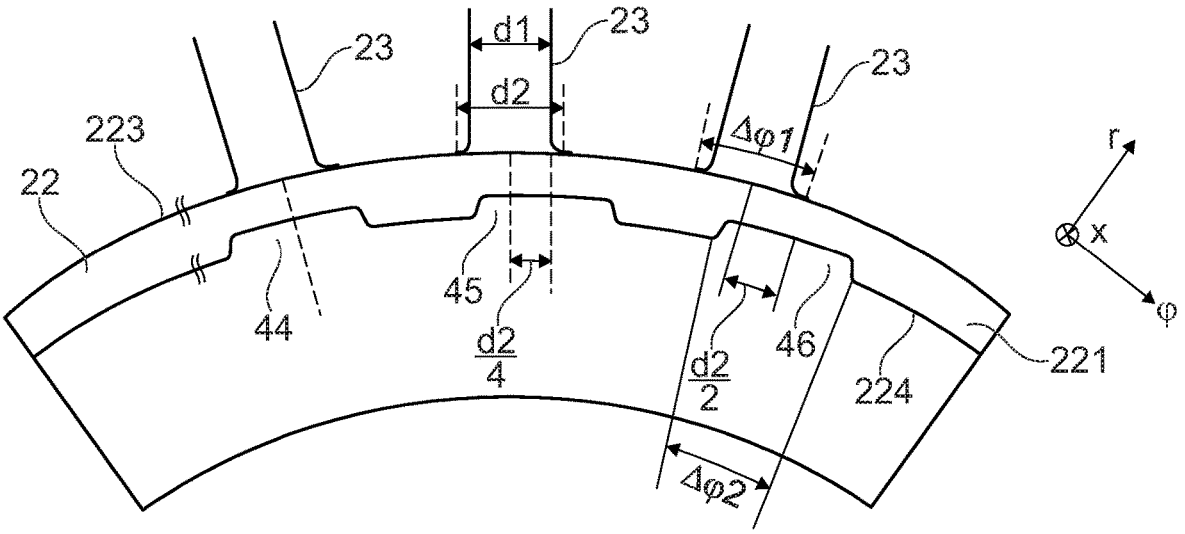
FIG. 5 shows, in a view from the front, an exemplary embodiment of a compressor rotor with indentations that are respectively embodied below a rotor blade, wherein multiple rotor blades and indentations are shown, and wherein the indentations are embodied with a changing position with respect to the rotor blades at the bottom side of the hub.

FIG. 5 shows an exemplary embodiment in which the contouring of the frontal bottom side of the hub 224 is realized in the circumferential direction $\varphi$ in a non-periodic manner in the sense that the indentations differ with respect to the relative position to the rotor blade at least at some of the rotor blades. Here, a non-periodic contouring is realized in such a manner that, for a group of neighboring blades, the relative position of the indentations with respect to the respective blade is shifted in the circumferential direction from one blade to the other.

What is regarded here in FIG. 5 is a group of four blades 23, of which three blades 23 are shown, with the relative position of the corresponding indentations 44, 45, 46 changing from one blade to the other, being shifted in the circumferential direction $\varphi$. If d2 is the maximum blade root thickness (which is defined in the same manner as with respect to FIG. 3) and if n is the number of the blades of the regarded group, the indentations are displaced by an angle $\Delta\varphi$ in the circumferential direction, which equals d2 divided by n, from one blade 23 to the other blade 23.

In the group of four blades that is regarded in FIG. 5, the indentation 44 is arranged so as to be centered with respect to the corresponding blade 23. In contrast, the indentation 45 is displaced by the angle $\Delta\varphi=d2/4$ in the circumferential direction $\varphi$. The indentation 46 is displaced in the circumferential direction $\varphi$ with respect to the indentation 45 by another angle $\Delta\varphi=d2/4$, so that the total displacement with respect to the indentation 44 is $\Delta\varphi=d2/2$. In the indentation that is succeeding in the circumferential direction that is not shown any more in FIG. 5, the total displacement with respect to the indentation 44 is at $\Delta\varphi=d2*3/4$. In the indentation that is then succeeding in the circumferential direction, what may for example again be present is a centered arrangement with respect to the corresponding blade 23, corresponding to the indentation 44 of FIG. 5. In this manner, it is ensured that, despite the displacements realized in the circumferential direction, the criterion is always fulfilled according to which the indentations 44, 45, 46 respectively lie in the area below a rotor blade 23, and thus the angular ranges $\Delta\varphi1$ and $\Delta\varphi2$ respectively covering the maximum blade root thickness d2 and the indentations 44, 45, 46 at least overlap, respectively.

Alternatively or additionally, such a displacement of the indentations can also be realized in the area of the rear bottom side of the hub 225 (cf. FIG. 2*a*).

Figure 6:
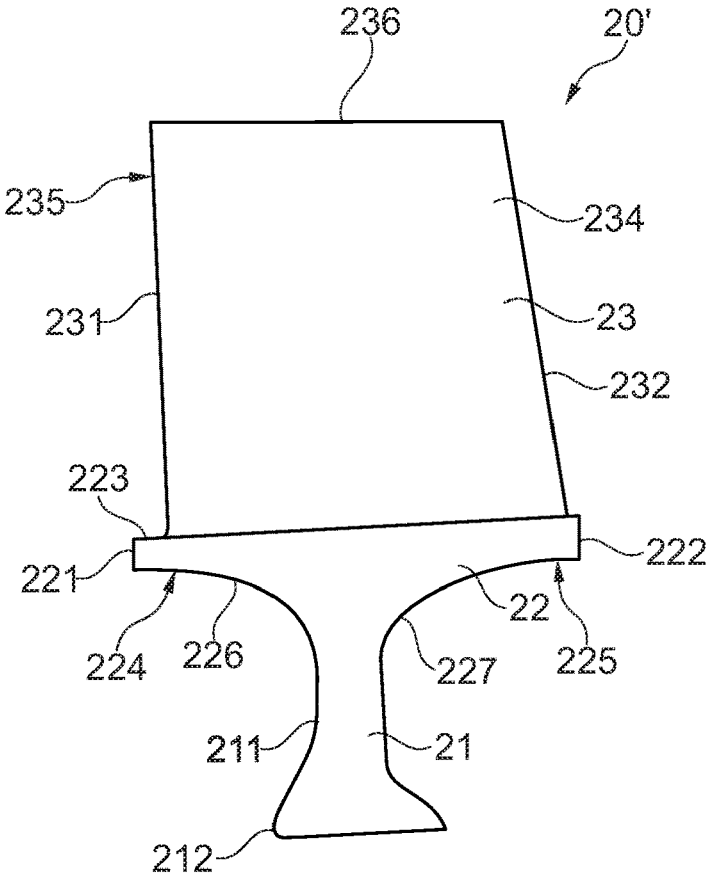
FIG. 6 shows a schematic rendering of a compressor rotor, in which the rotor hub forms an elliptical boundary line at the bottom side of the hub.

FIG. 6 shows an exemplary embodiment that is characterized by a specific contouring of the frontal bottom side of the hub and/or the rear bottom side of the hub. According to FIG. 2*a*, a compressor rotor 20' having a rotor disk 21, a rotor hub 22 and a plurality of rotor blades 23 is provided, wherein the rotor blades 23 respectively have a leading edge 231, a trailing edge 232, a pressure side 234, a suction side 235, and a blade tip 236. The rotor hub 22 has a leading edge 221, a trailing edge 222, a top side of the hub 223, a frontal bottom side of the hub 224, and a rear bottom side of the hub 225. The rotor disk 21 has a disk-shaped area 211 and a disk root 212.

It is provided that, in the meridional section, the boundary line 226 of the frontal bottom side of the hub 224 can be described by an ellipse at least adjoining at the leading edge 221. Alternatively or additionally, it is provided that, in the meridional section, the boundary line 227 of the rear bottom side of the hub 225 can be described by an ellipse at least adjoining at the trailing edge 222. At that, the described contouring is circumferentially symmetrical, meaning that it applies to each meridional section through the rotor hub 22.

It can be provided that the boundary line 226 and/or the boundary line 227 is embodied in an elliptical manner in its total length up to the transition to the rotor disk 21 or its disk-shaped area 211. Alternatively, it can be provided that the boundary line 226 and/or the boundary line 227 is embodied in an elliptical manner only over a part of its length, for example across a section that adjoins the leading edge 221 or the trailing edge 222 and that has an axial component in the range of between 10% and 30% of the axial extension of the rotor hub 22 (i.e. between the leading edge 221 and the trailing edge 222).

Figure 7:
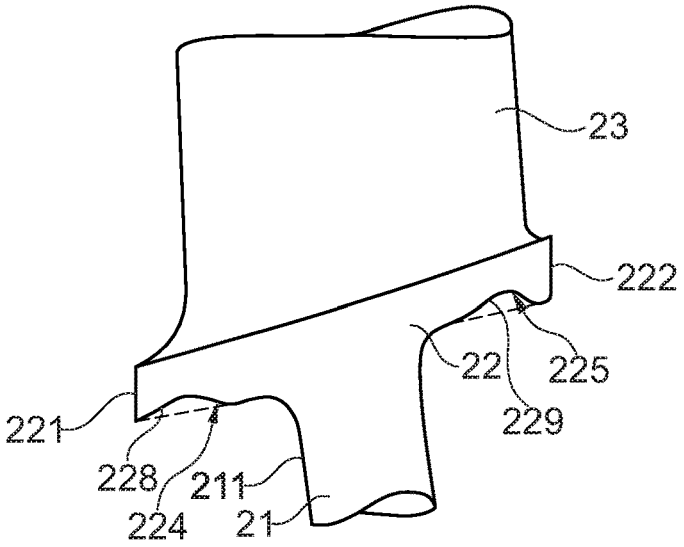
FIG. 7 shows a schematic rendering of a compressor rotor that has a further contouring at the bottom side of the hub of the rotor hub.

FIG. 7 shows further circumferentially symmetrical contourings of the rotor hub 22 in the area of the bottom side of the hub. Here, the frontal bottom side of the hub 224 and/or the rear bottom side of the hub 225 has an indentation 228, 229 set against a linear contour that is indicated by a dashed line and extends circumferentially in a symmetrical manner. In this manner, the softness of the rotor hub 22 in the area of the outer edges 221, 222 is generally increased.

The present invention is not limited in its embodiment to the previously described exemplary embodiments. For example, the shape of the indentations in FIGS. 3-5 is to be understood merely as an example.

It is furthermore pointed out that the features of the individually described exemplary embodiments of the invention can be combined in various combinations with one another. Where areas are defined, they include all the values within these areas and all the sub-areas falling within an area.

What is claimed is:

1. A compressor rotor of a turbomachine, comprising:

a rotor disk that is rotatable about a rotational axis that defines an axial direction, wherein a radial direction extends perpendicular to the axial direction and a circumferential direction extends perpendicular to the axial direction and to the radial direction, a rotor hub that forms a radially outer edge of the rotor disk or is connected to the rotor disk, and a plurality of rotor blades that are arranged at the rotor hub and extend radially outwards, wherein the rotor hub comprises: an axially frontal leading edge, an axially rear trailing edge, a top side of the rotor hub from which the plurality of rotor blades project, a frontal bottom side of the rotor hub that extends on a bottom side of the rotor hub from the axially frontal leading edge toward the rotor disk and transitions into the rotor disk, and a rear bottom side of the rotor hub that extends on the bottom side of the rotor hub from the axially rear trailing edge toward the rotor disk and transitions into the rotor disk, wherein at least one chosen from the frontal bottom side of the rotor hub and the rear bottom side of the rotor hub is contoured to change a radial thickness of the rotor hub along the circumferential direction of the rotor hub to form a plurality of indentations in the rotor hub, with a quantity of the plurality of indentations equaling a quantity of the plurality of rotor blades and with an individual one of the plurality of indentations respectively positioned below each of the plurality of rotor blades such that the rotor hub has a relative reduction in thickness below each of the plurality of rotor blades;

wherein in at least one section through the rotor hub in a lane transverse with respect to the rotational axis, in the circumferential direction, a maximum blade root thickness and the individual one of the plurality of indentations cover first and second angular ranges, respectively, which overlap with each other, wherein the maximum blade root thickness is defined as an area of a rotor blade that extends in the circumferential direction and that extends from a rounded-off portion of the rotor blade on a suction side up to a rounded-off portion of the rotor blade on a pressure side of the rotor blade, wherein the first angular range lies completely inside the second angular range.

2. The compressor rotor according to claim 1, wherein the rotor hub respectively forms the individual one of the plurality of indentations starting from at least one chosen from the axially frontal leading edge and the axially rear trailing edge.

3. The compressor rotor according to claim 1, wherein the individual one of the plurality of indentations is embodied in a concave manner and extends in the axial direction toward the rotor disk.

4. The compressor rotor according to claim 3, wherein a depth of the individual one of the plurality of indentations decreases toward the rotor disk.

5. The compressor rotor according to claim 1, wherein the individual one of the plurality of indentations extends in the circumferential direction over a length that is between half and five times the maximum blade root thickness.

6. The compressor rotor according to claim 1, wherein, in the at least one section through the rotor hub in the plane transverse with respect to the rotational axis, a maximum thickness reduction of the rotor hub is provided through the individual one of the plurality of indentations in a range of between 5% and 30% with respect to the thickness of the rotor hub in a middle between two adjacent rotor blades of the plurality of rotor blades.

7. The compressor rotor according to claim 1, and further comprising at least one chosen from contouring of the frontal bottom side of the rotor hub and contouring of the rear bottom side of the rotor hub in the circumferential direction is provided in a periodic manner such that the plurality of indentations have a same relative position to the plurality of rotor blades at all of the plurality of rotor blades.

8. The compressor rotor according to claim 1, and further comprising at least one chosen from contouring of the frontal bottom side of the rotor hub and contouring of the rear bottom side of the rotor hub in the circumferential direction is provided in a non-periodic manner such that the plurality of indentations differ with respect to the relative position to the plurality of rotor blades at least at some of the plurality of rotor blades.

9. The compressor rotor according to claim 8, wherein the contouring is realized in such a way in the non-periodic manner that, for a group of adjacent guide vanes, the relative position of the individual one of the plurality of indentations with respect to the respective guide vane is shifted in the circumferential direction from one of the plurality of rotor blades to another of the plurality of rotor blades.

10. The compressor rotor according to claim 8, wherein, in a group of adjacent rotor blades of the plurality of rotor blades, a relative position of the plurality of indentations to a respective one of the group of adjacent rotor blades is shifted in the circumferential direction in such a manner that, if d2 is the maximum blade root thickness and n is a number of the adjacent rotor blades of the group, the plurality of indentations are displaced in the circumferential direction from one blade of the group to another blade of the group by an angle that equals d2 divided by n.

11. The compressor rotor according to claim 10, wherein the regarded group of adjacent rotor blades has between three and seven rotor blades.

12. The compressor rotor according to claim 10, wherein the regarded group of adjacent rotor blades has between four and six rotor blades.

13. The compressor rotor according to claim 1, wherein the rotor disk, the rotor hub and the plurality of rotor blades are embodied in an integral manner.

14. The compressor rotor according to claim 1, wherein the rotor hub and the plurality of rotor blades are embodied in an integral manner.

15. The compressor rotor according to claim 1, wherein the individual one of the plurality of indentations extends in the circumferential direction over a length that is between the maximum blade root thickness and three times the maximum blade root thickness.

16. The compressor rotor according to claim 1, wherein the maximum thickness reduction of the rotor hub is provided through the individual one of the plurality of indentations in a range of between 10% and 20% with respect to the thickness of the rotor hub in a middle between two adjacent rotor blades of the plurality of rotor blades.

17. A compressor rotor of a turbomachine configured as a BLISK or a BLING, comprising:

a rotor disk that is rotatable about a rotational axis that defines an axial direction, wherein a radial direction extends perpendicular to the axial direction and a circumferential direction extends perpendicular to the axial direction and to the radial direction, a rotor hub that forms a radially outer edge of the rotor disk or is connected to the rotor disk, and a plurality of rotor blades that are arranged at the rotor hub and extend radially outwards, wherein the rotor hub comprises: an axially frontal leading edge, an axially rear trailing edge, a top side of the rotor hub from which the plurality of rotor blades project, a frontal bottom side of the rotor hub that extends on a bottom side of the rotor hub from the axially frontal leading edge toward the rotor disk and transitions into the rotor disk, and a rear bottom side of the rotor hub that extends on the bottom side of the rotor hub from the axially rear trailing edge toward the rotor disk and transitions into the rotor disk, wherein at least one chosen from the frontal bottom side of the rotor hub and the rear bottom side of the rotor hub is contoured to change a radial thickness of the rotor hub along the circumferential direction of the rotor hub to form a plurality of indentations in the rotor hub, with a quantity of the plurality of indentations equaling a quantity of the plurality of rotor blades and with an individual one of the plurality of indentations respectively positioned below each of the plurality of rotor blades such that the rotor hub has a relative reduction in thickness below each of the plurality of rotor blades, wherein, the plurality of indentations are respectively formed in the rotor hub starting from at least one chosen from the axially frontal leading edge and the axially rear trailing edge, the plurality of indentations are embodied in a concave manner and extend in the axial direction toward the rotor disk, in at least one section through the rotor hub in a plane transverse with respect to the rotational axis, in the circumferential direction, a maximum blade root thickness and the individual one of the plurality of indentations cover first and second angular ranges, respectively, which overlap with each other, wherein the maximum blade root thickness is defined as an area of a rotor blade that extends in the circumferential direction and extends from a rounded-off portion of the rotor blade on a suction side up to a rounded-off portion of the blade on a pressure side of the rotor blade, wherein the first angular range lies completely inside the second angular range, and the plurality of indentations extend in the circumferential direction over a length that is between half and five times the maximum blade root thickness, wherein the BLISK incorporates the rotor disk, the rotor hub and the plurality of rotor blades in an integral manner and the BLING incorporates the rotor hub and the plurality of rotor blades in an integral manner.

18. A compressor rotor of a turbomachine configured as a BLISK or a BLING, comprising:

a rotor disk that is rotatable about a rotational axis that defines an axial direction, wherein a radial direction extends perpendicular to the axial direction and a circumferential direction extends perpendicular to the axial direction and to the radial direction, a rotor hub that forms a radially outer edge of the rotor disk or is connected to the rotor disk, and a plurality of rotor blades that are arranged at the rotor hub and extend radially outwards, wherein the rotor hub comprises: an axially frontal leading edge, an axially rear trailing edge, a top side of the rotor hub from which the plurality of rotor blades project, a frontal bottom side of the rotor hub that extends on a bottom side of the rotor hub from the axially frontal leading edge toward the rotor disk and transitions into the rotor disk, and a rear bottom side of the rotor hub that extends on the bottom side of the rotor hub from the axially rear trailing edge toward the rotor disk and transitions into the rotor disk, wherein at least one chosen from the frontal bottom side of the rotor hub and the rear bottom side of the rotor hub is contoured to change a radial thickness of the rotor hub along the circumferential direction of the rotor hub to form a plurality of indentations in the rotor hub, with a quantity of the plurality of indentations equaling a quantity of the plurality of rotor blades and with an individual one of the plurality of indentations respectively positioned below each of the plurality of rotor blades such that the rotor hub has a relative reduction in thickness below each of the plurality of rotor blades and such that in each meridional section through the rotor hub, at least one chosen from a boundary line of the frontal bottom side of the rotor hub at least adjoining at the axially frontal leading edge and a boundary line of the rear bottom side of the rotor hub at least adjoining at the axially rear trailing edge is shaped as an ellipse, wherein the BLISK incorporates the rotor disk, the rotor hub and the plurality of rotor blades in an integral manner and the BLING incorporates the rotor hub and the plurality of rotor blades in an integral manner, wherein, in at least one section through the rotor hub in a lane transverse with respect to the rotational axis, in the circumferential direction, a maximum blade root thickness and the individual one of the plurality of indentations cover first and second angular ranges, respectively, which overlap with each other, wherein the maximum blade root thickness is defined as an area of a rotor blade that extends in the circumferential direction and that extends from a rounded-off portion of the rotor blade on a suction side up to a rounded-off portion of the rotor blade on a pressure side of the rotor blade, wherein the first angular range lies completely inside the second angular range.

19. The compressor rotor according to claim 18, wherein the boundary line is embodied so as to be elliptic in its entire length up to the transition to the rotor disk.

* * * * *